US007484722B2

(12) United States Patent
Ishii

(10) Patent No.: US 7,484,722 B2
(45) Date of Patent: Feb. 3, 2009

(54) IMAGE-FORMING DEVICE

(75) Inventor: Makoto Ishii, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 391 days.

(21) Appl. No.: 11/443,313

(22) Filed: May 31, 2006

(65) Prior Publication Data

US 2006/0269320 A1 Nov. 30, 2006

(30) Foreign Application Priority Data

May 31, 2005 (JP) ..... 2005-160167

(51) Int. Cl.
*B65H 3/44* (2006.01)

(52) U.S. Cl. ..... 271/9.09; 271/218; 399/392

(58) Field of Classification Search ..... 271/9.09, 271/213, 218; 399/391, 392
See application file for complete search history.

(56) References Cited

U.S. PATENT DOCUMENTS 5,111,252 A * 5/1992 Hamada et al. ..... 399/393
6,012,148 A * 1/2000 Laberge et al. ..... 714/2
6,612,561 B2 * 9/2003 Sekine ..... 271/3.14
7,062,216 B2 * 6/2006 Nobe et al. ..... 399/391
7,366,459 B2 * 4/2008 Nishimura ..... 399/392
2005/0141936 A1 * 6/2005 Kawashima ..... 399/392
2005/0141937 A1 * 6/2005 Nishimura ..... 399/392

FOREIGN PATENT DOCUMENTS

| | | |
|---|---|---|
| JP | 6-61844 | 9/1994 |
| JP | 7010350 | 1/1995 |
| JP | 9020445 | 1/1997 |
| JP | 2001134033 | 5/2001 |
| JP | 2002104694 | 4/2002 |
| JP | 2002351282 | 12/2002 |

* cited by examiner

*Primary Examiner*—Kaitlin S Joerger
(74) *Attorney, Agent, or Firm*—Banner & Witcoff, Ltd.

(57) ABSTRACT

An image-forming device includes an extension tray and an engaging unit. The cover member is capable of opening and closing thereon. The extension tray is rotatably attached to an upper part of the cover member. The engaging unit engages the cover member with the main casing when the cover member is closed. The engaging unit includes an engagement part, an engaging part, and an operating part. The operating part disengages the engaging part from the engagement part when operated. The operating part is capable of being operated when the extension tray is closed.

11 Claims, 17 Drawing Sheets

IMAGE-FORMING DEVICE

CROSS REFERENCE TO RELATED APPLICATION

This application claims priority from Japanese Patent Application No. 2005-160167 filed on May 31, 2005, the content of which is hereby incorporated by reference.

TECHNICAL FIELD

The disclosure relates to an image-forming device.

BACKGROUND

Image-forming devices well known in the art include printers and other devices having a main casing with a discharge tray formed on the top surface of the main casing for receiving paper discharged after the image-forming process. One such image-forming device disclosed in Japanese unexamined patent application publication No. 2002-104694 includes an extension tray mounted on the top surface of the main casing for receiving paper of a large size.

SUMMARY

When in use, the extension tray is fixed so as to extend from the discharge tray downstream in the direction that paper is discharged. The extension tray supports the leading end of the large paper discharged on the discharge tray and restricts the paper from moving farther in the discharge direction.

It is an object of the invention to provide an improved image-forming device having an extension tray that is compact but capable of supporting a large recording medium while maintaining operability.

In order to attain the above and other objects, the invention provides an image-forming device. The image-forming device includes a main casing, a cover member, an extension tray, and an engaging unit. The main casing has a discharge tray formed on a top surface thereof. The discharge tray supports a recording medium discharged after an image-forming operation. The cover member covers a side surface of the main casing on a downstream side with respect to a discharge direction in which the recording medium is discharged. The cover member is capable of opening and closing thereon. The extension tray is rotatably attached to an upper part of the cover member. The extension tray is capable of extending downstream from the discharge tray in the discharge direction. The extension tray supports a portion of the discharged recording medium. The engaging unit engages the cover member with the main casing when the cover member is closed. The engaging unit includes an engagement part, an engaging part, and an operating part. The engagement part is provided on the main casing side. The engaging part is provided on the cover member side and is capable of engaging with the engagement part. The operating part is disposed on the cover member side. The operating part disengages the engaging part from the engagement part when operated. The extension tray has a rotational shaft provided downstream of the operating part in the discharge direction and is rotatably supported on the cover member about the rotational shaft to be capable of rotating between a first position in which a distal end of the extension tray is positioned upstream of the rotational shaft in the discharge direction and a second position in which the distal end is positioned downstream of the rotational shaft in the discharge direction. The operating part is capable of being operated when the extension tray is in the first position.

Figure 1:
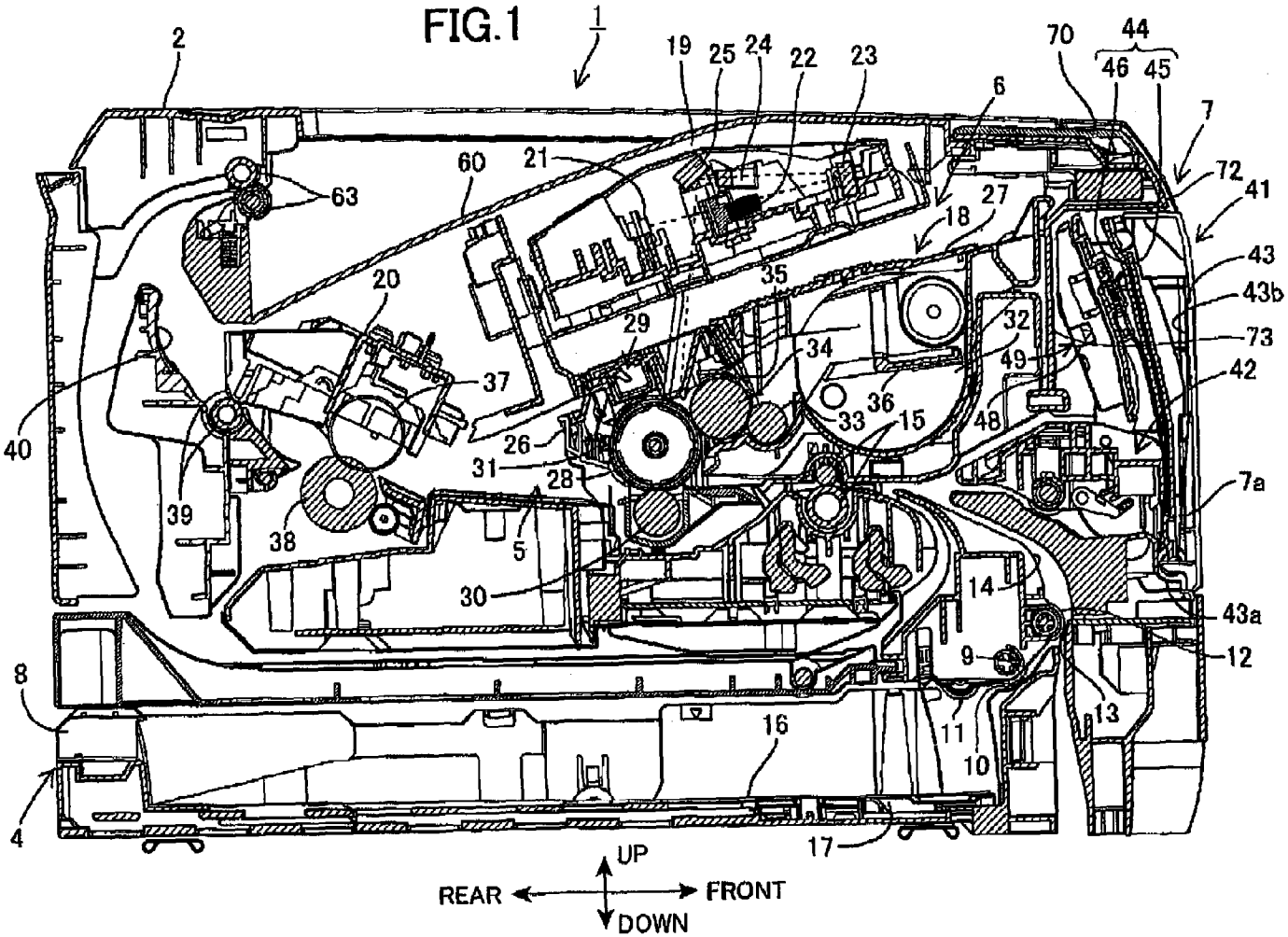
FIG. 1 is a side cross-sectional view of a laser printer according to an embodiment of the invention.
Figure 3:
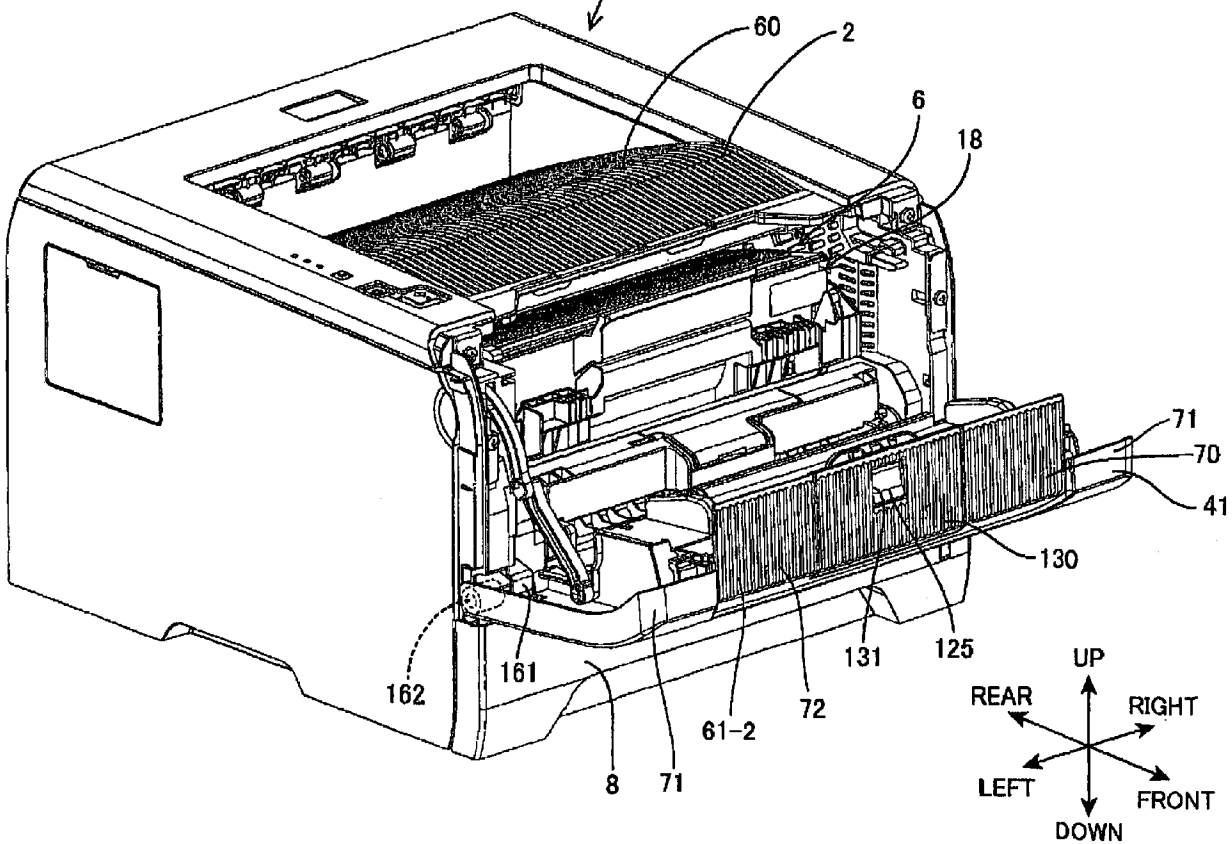
Figure 4:
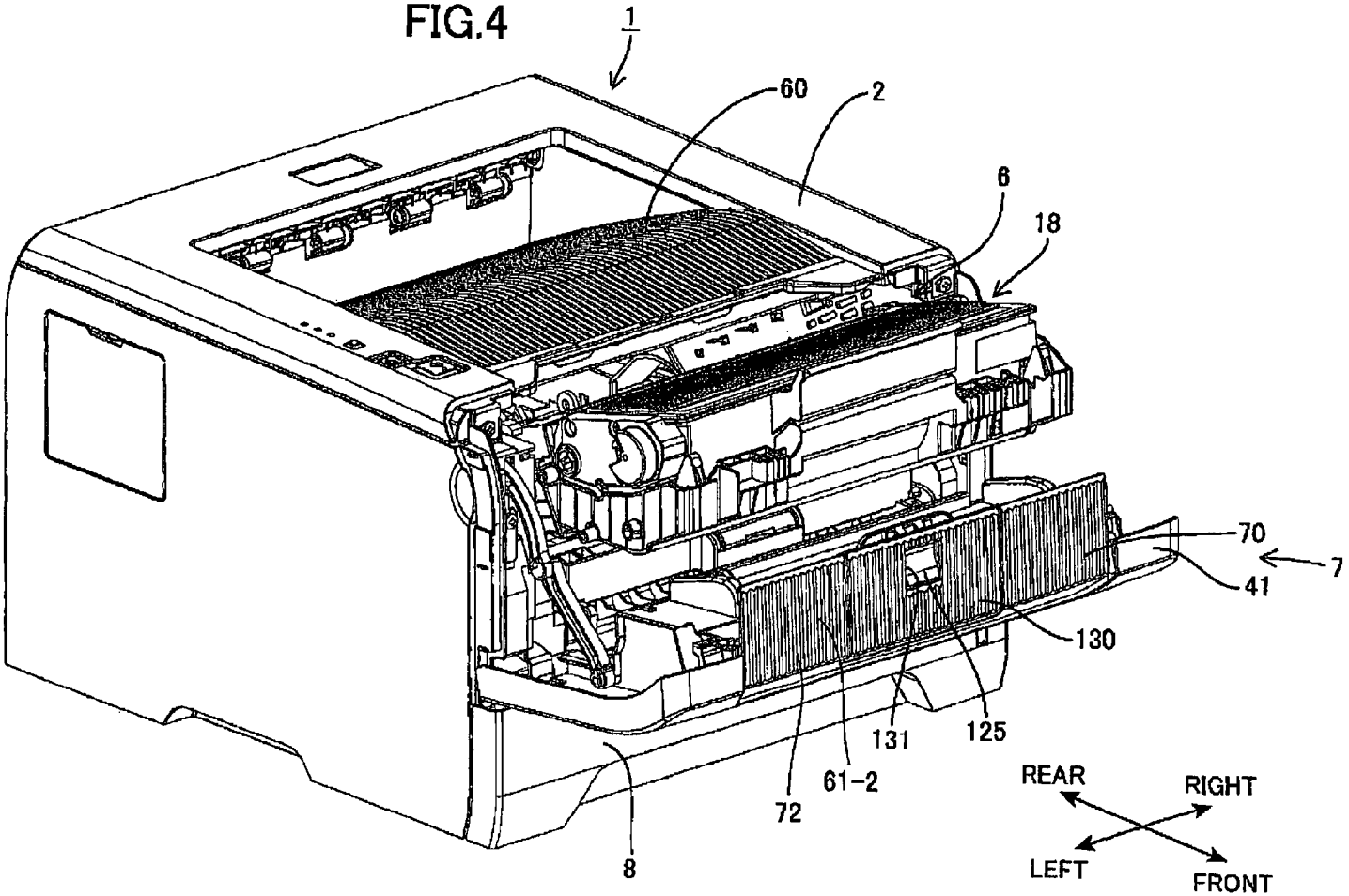
Figure 5:
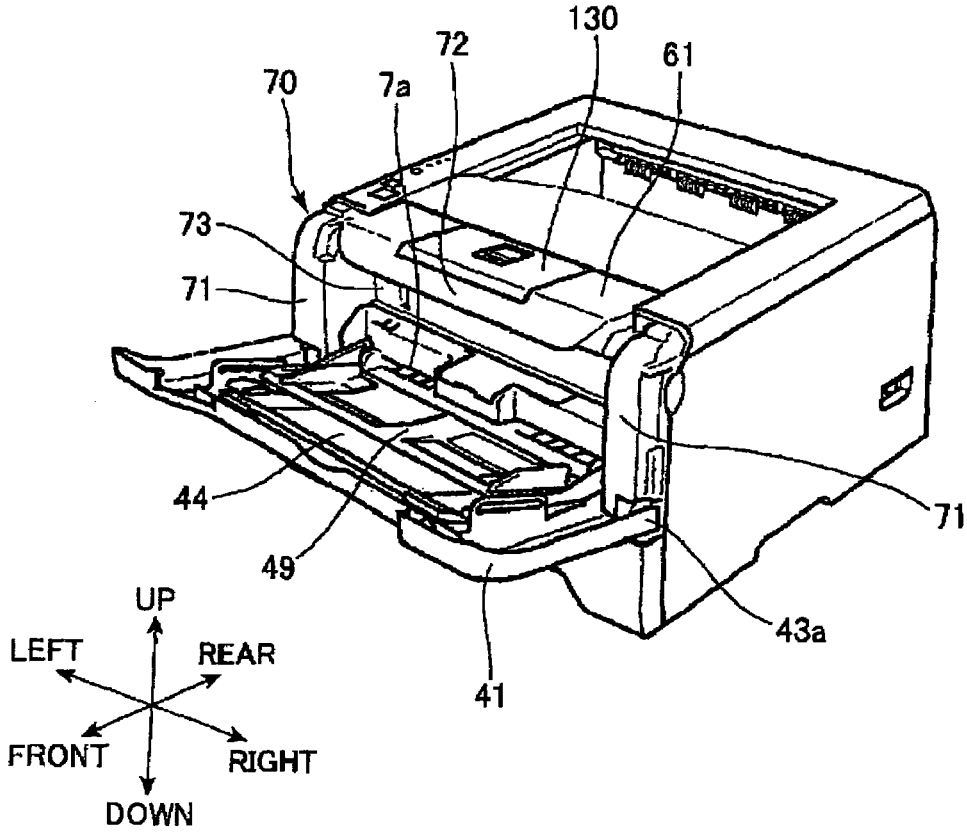
Figure 6:
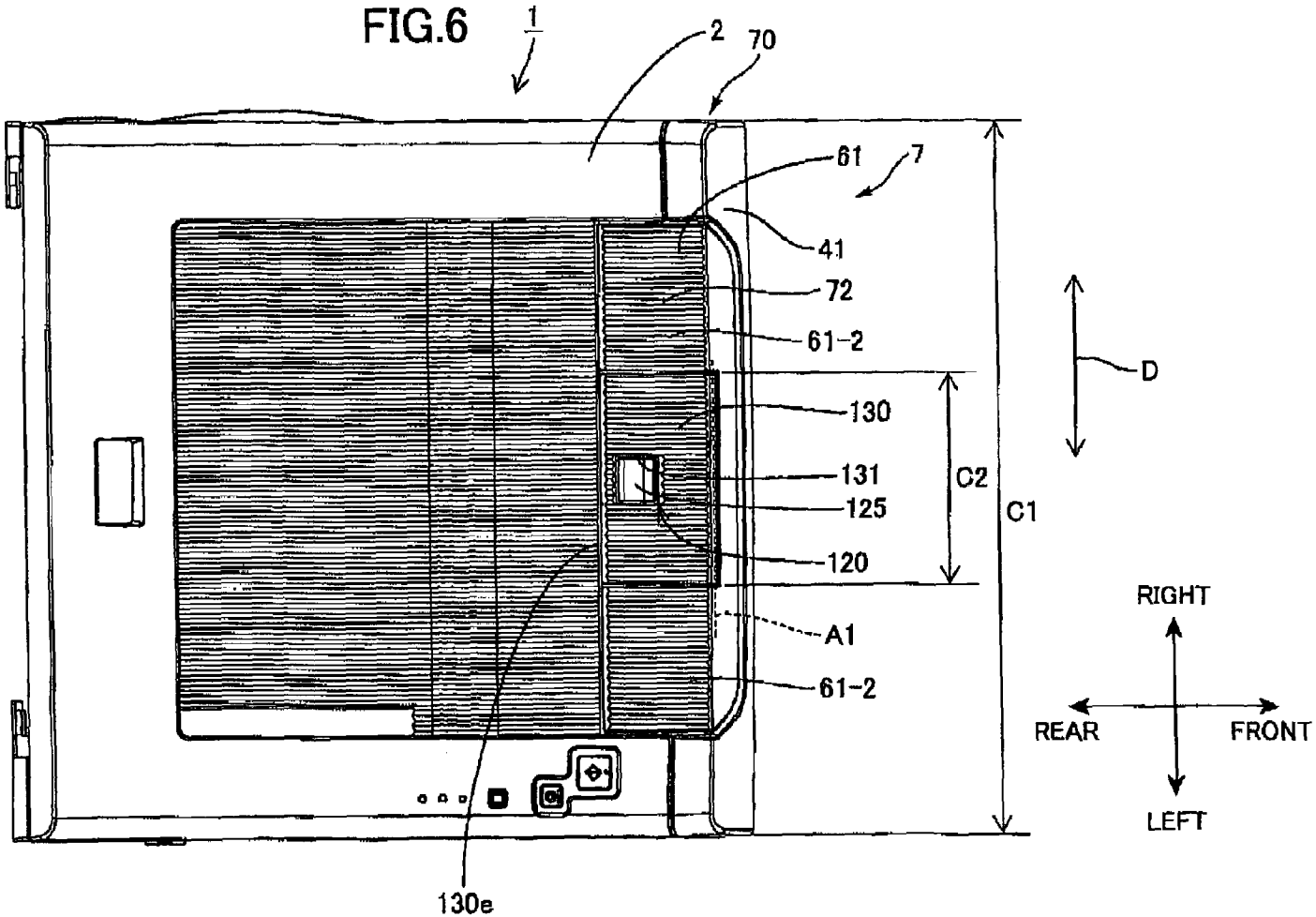
Figure 7:
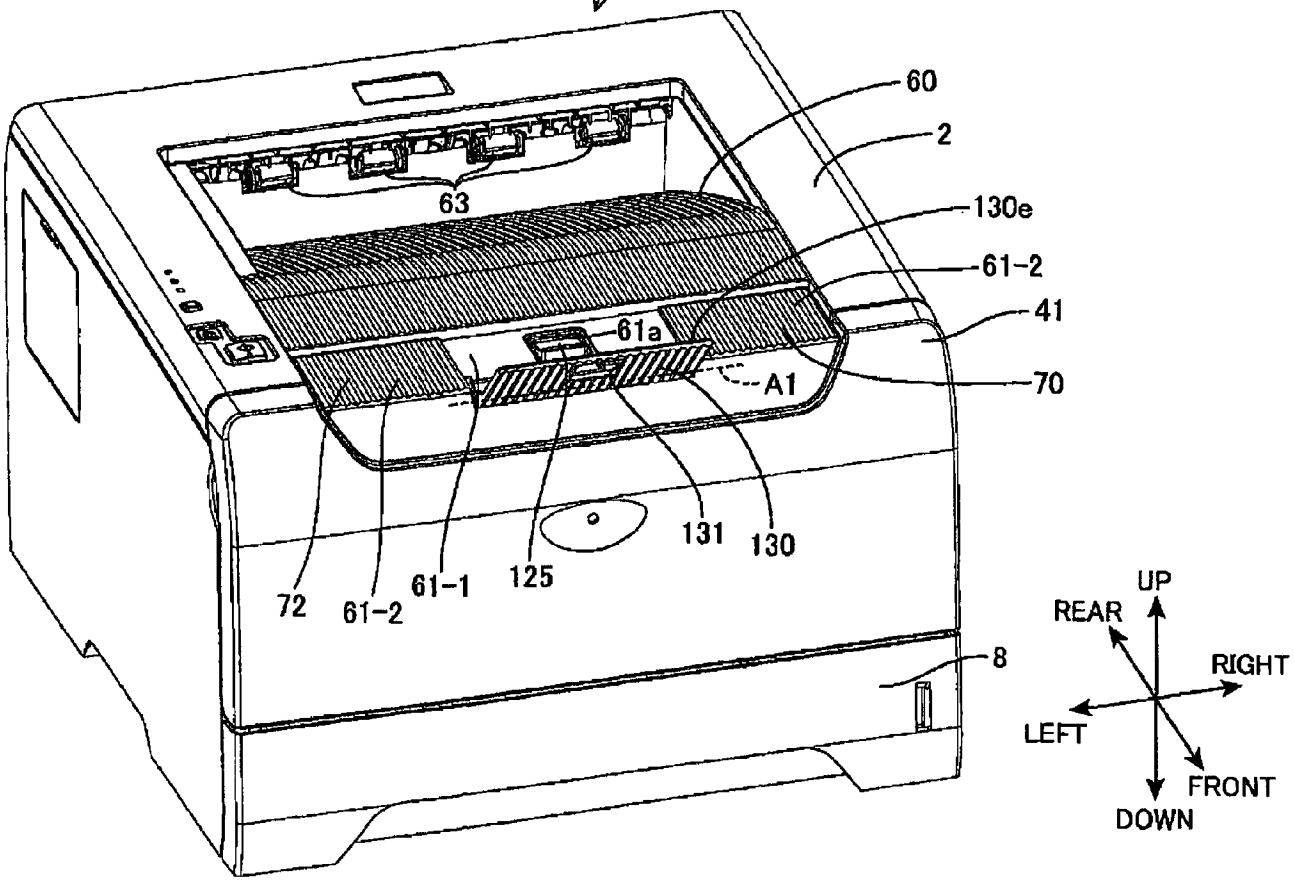
Figure 8:
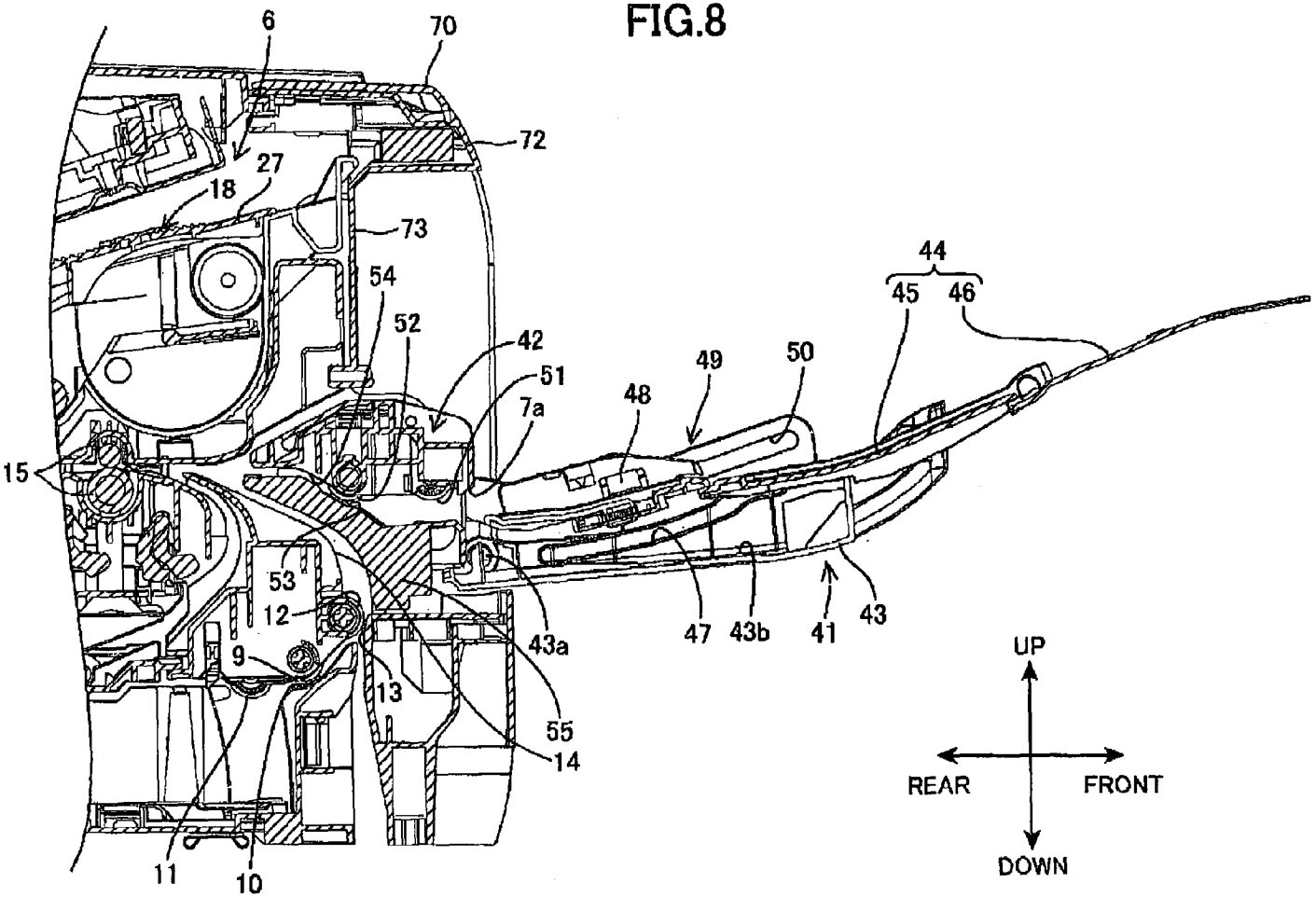
Figure 9A:
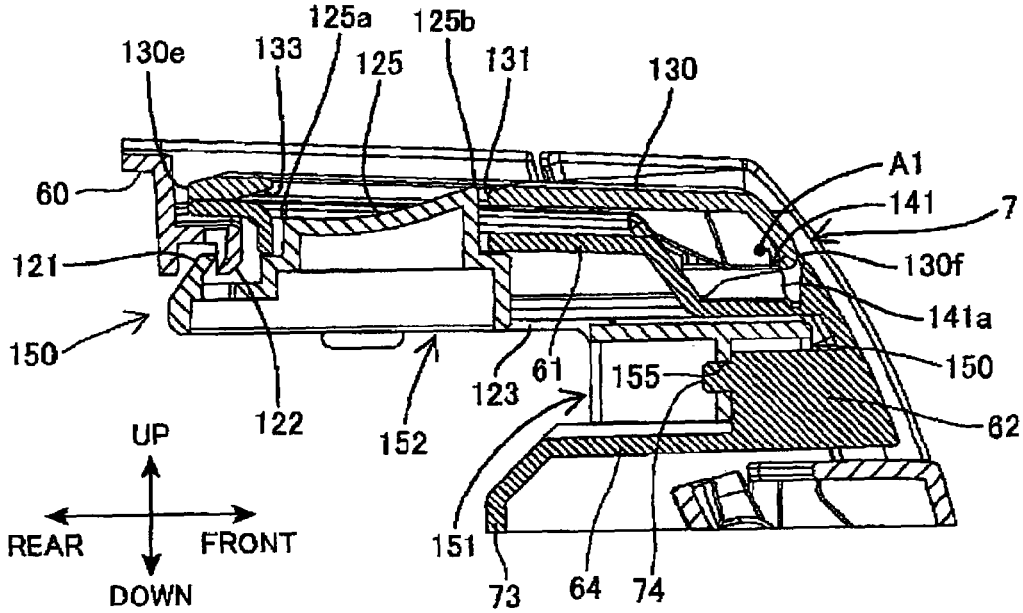
Figure 9B:
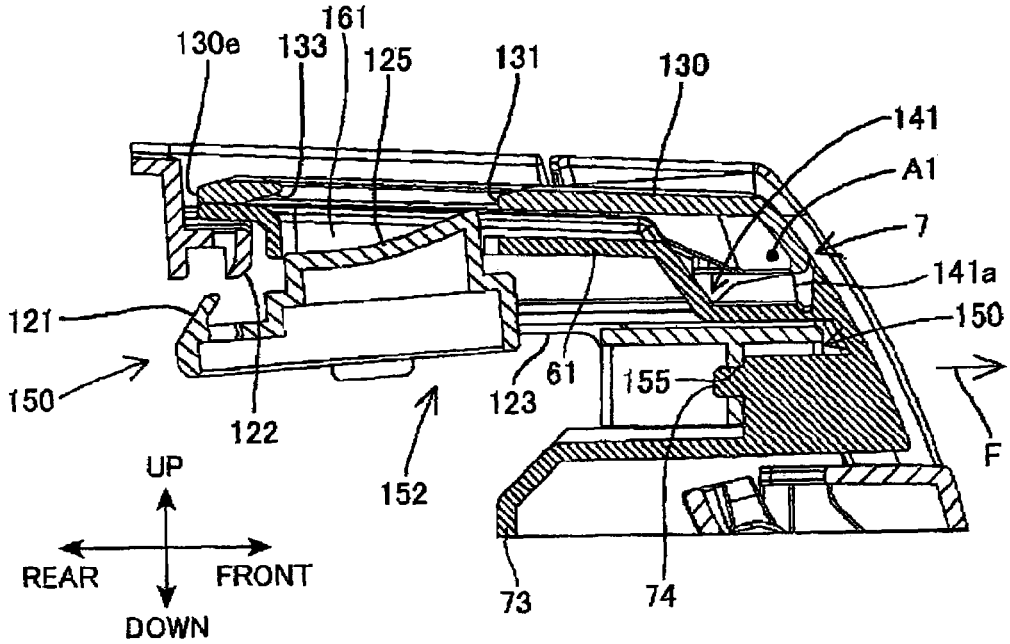
Figure 9C:
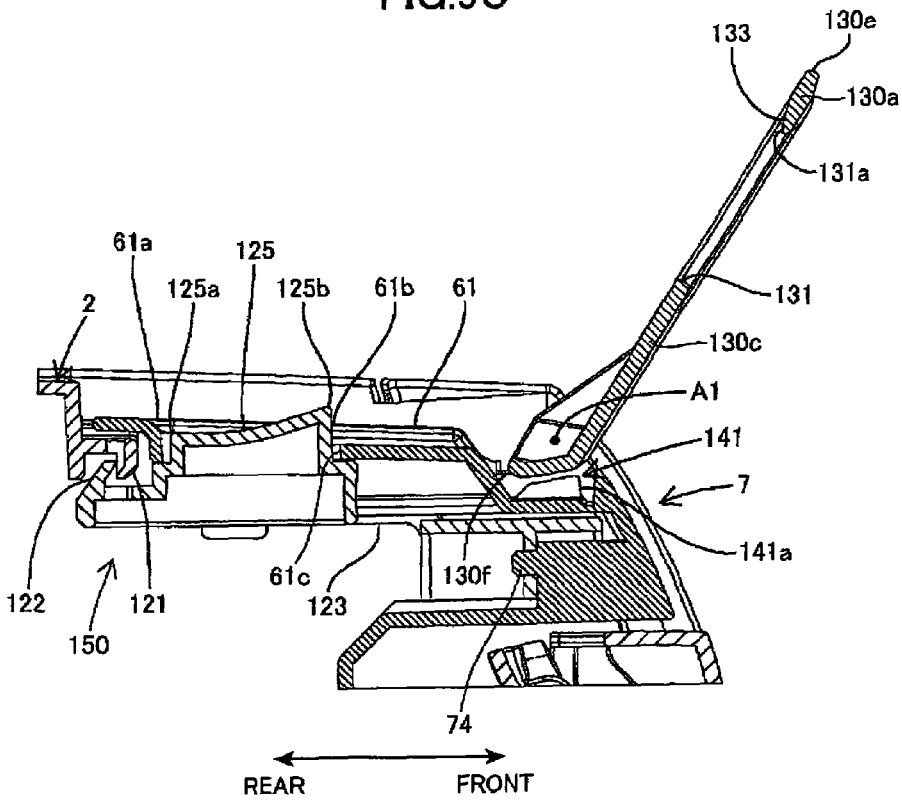
Figure 10:
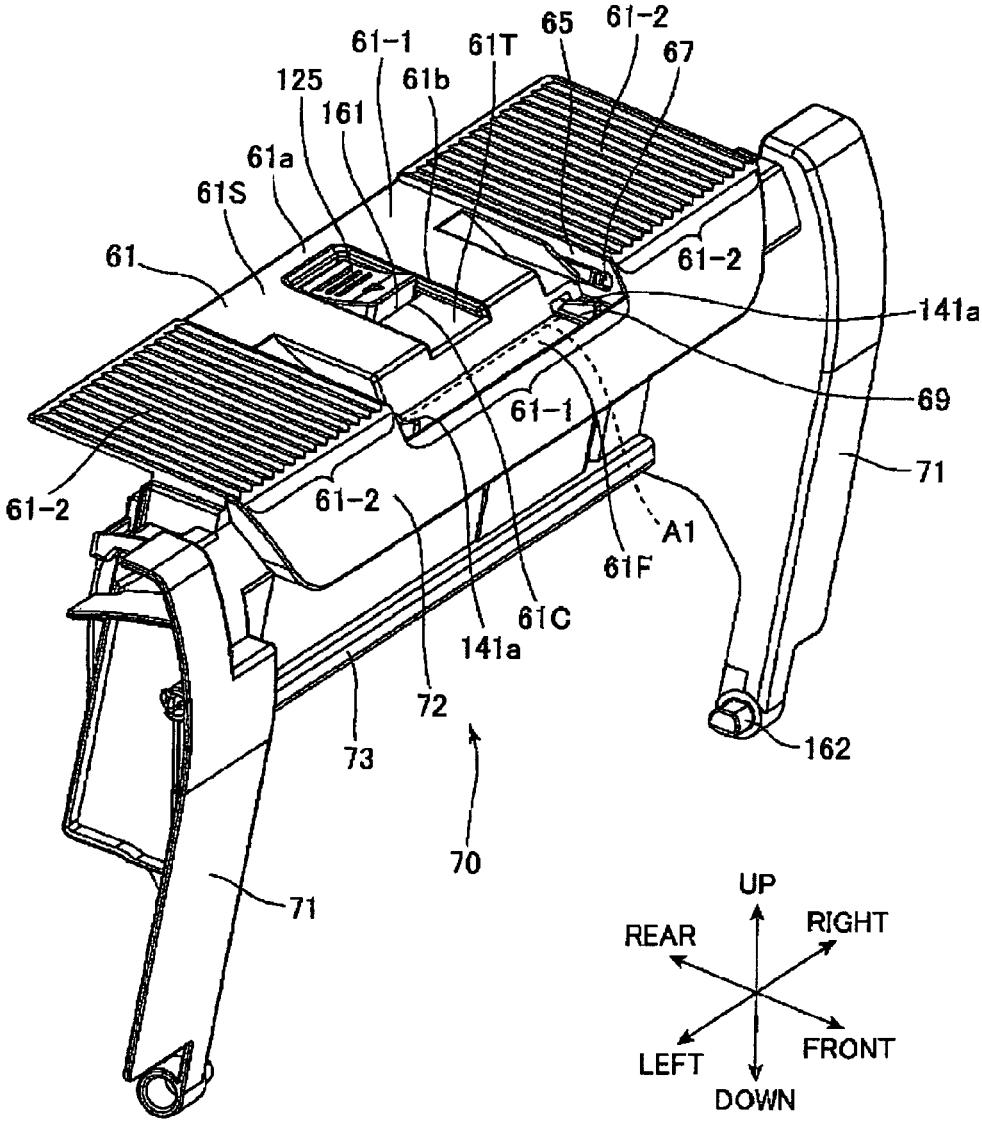
Figure 11:
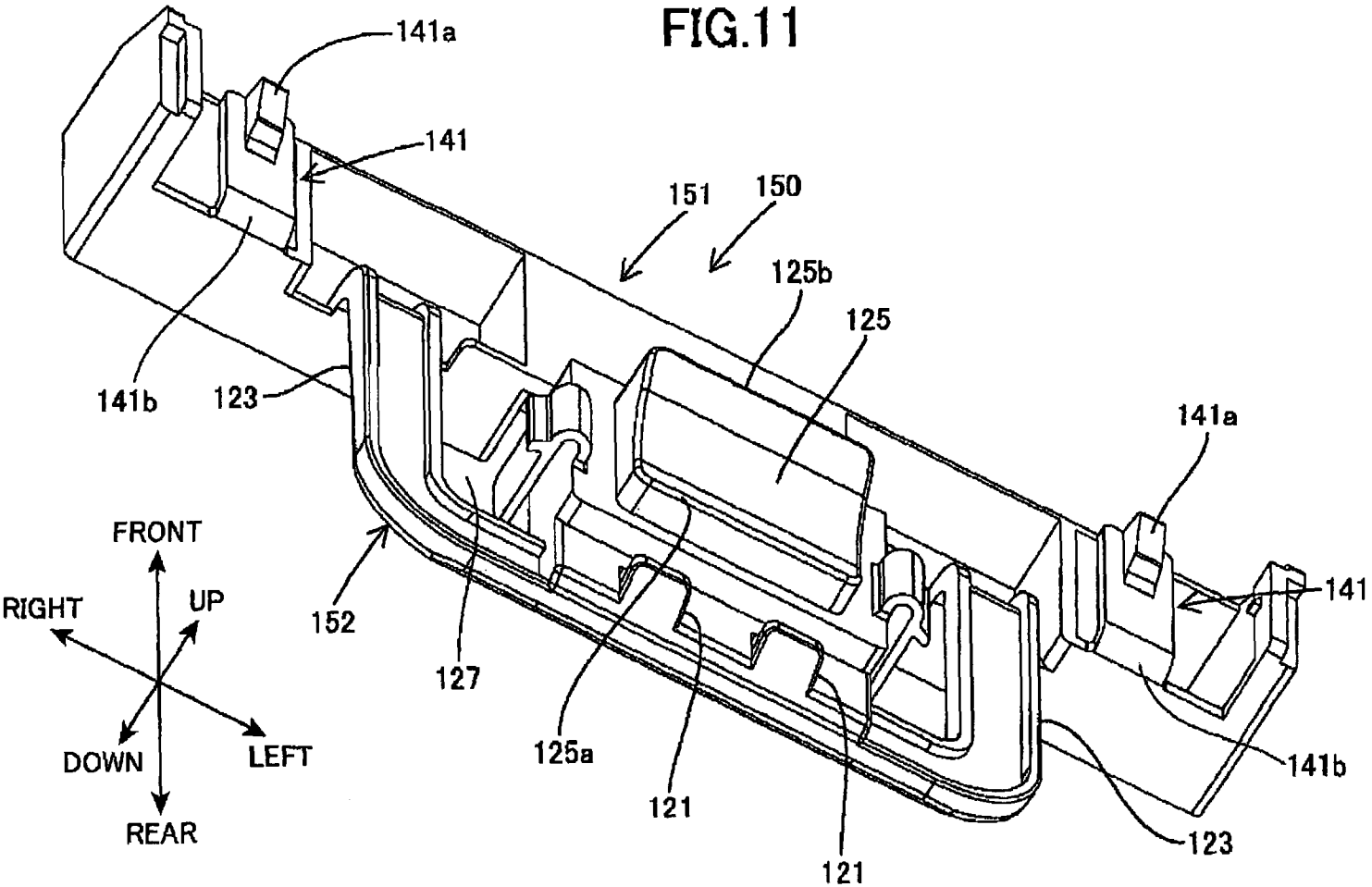
Figure 12:
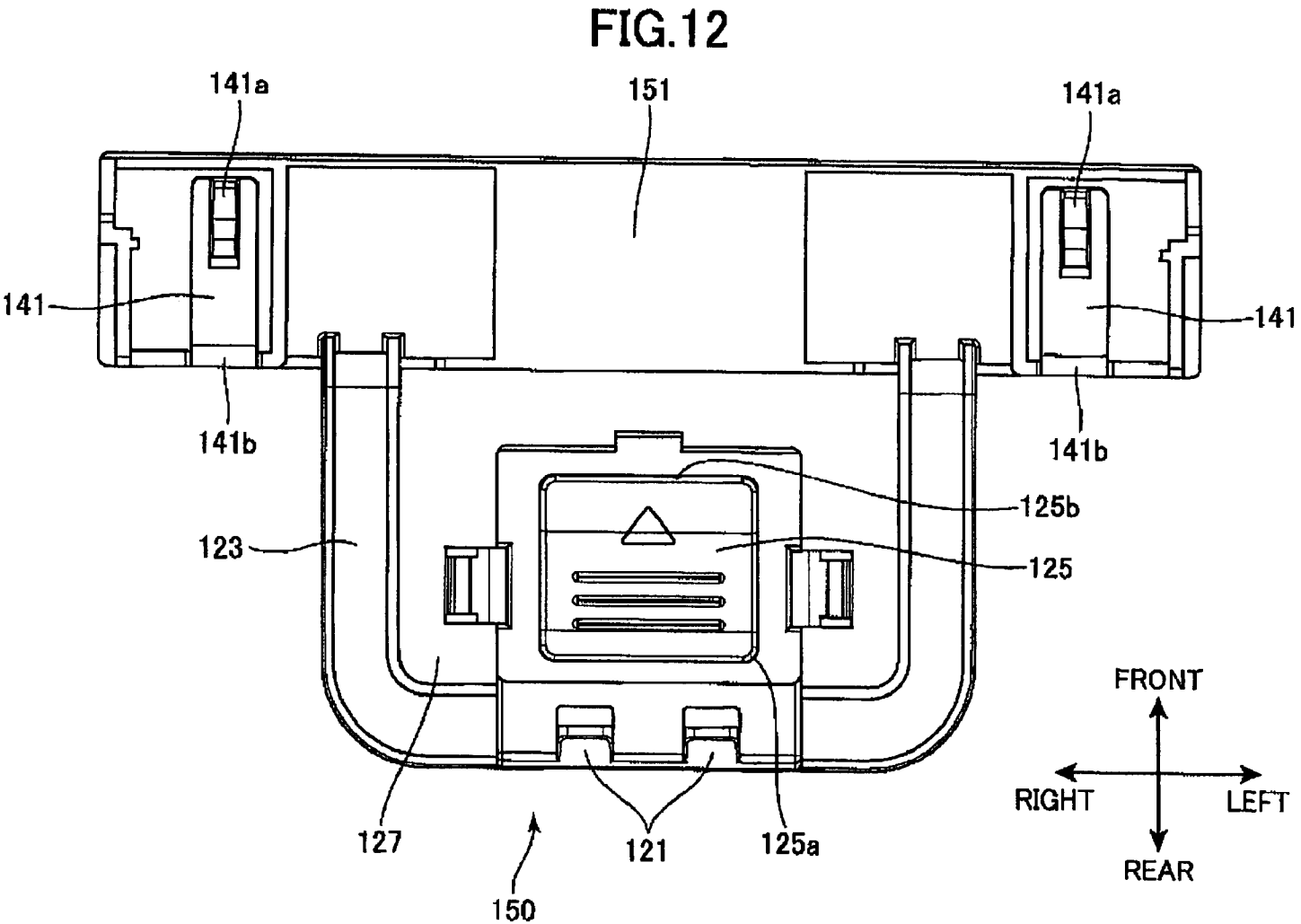
Figure 13A:
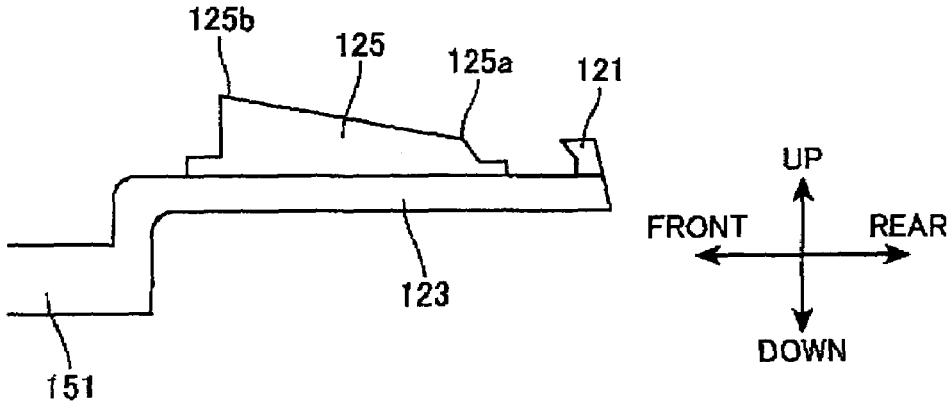
Figure 13B:
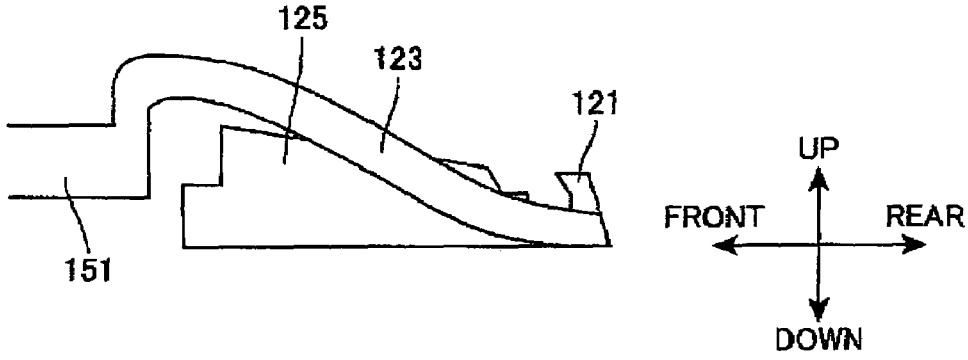
Figure 14:
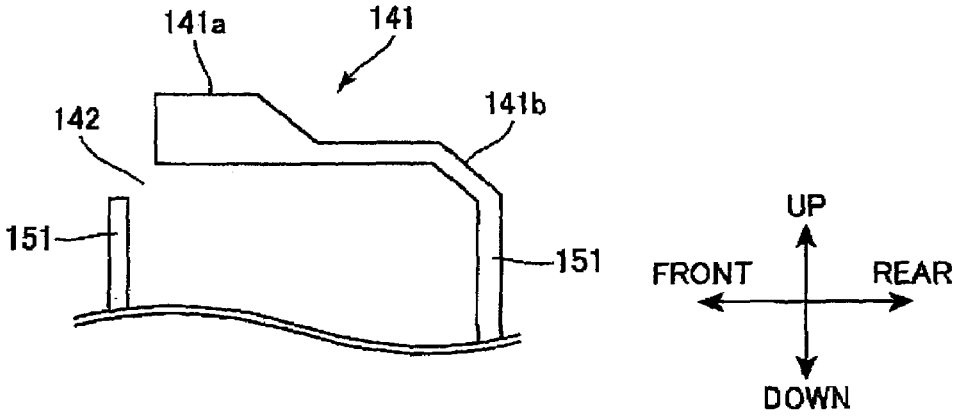
Figure 15:
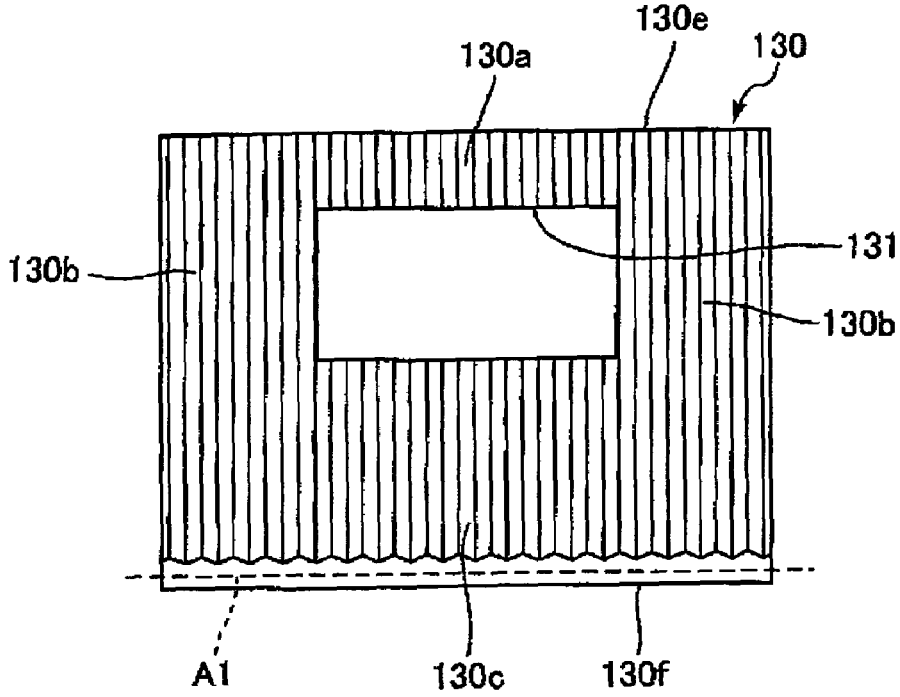
Figure 16A:
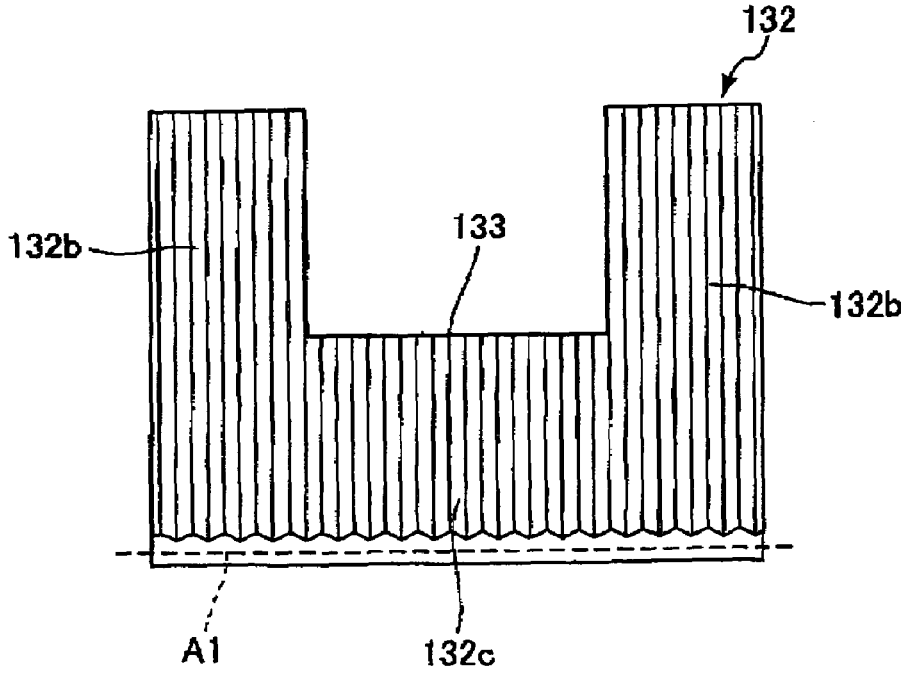
Figure 16B:
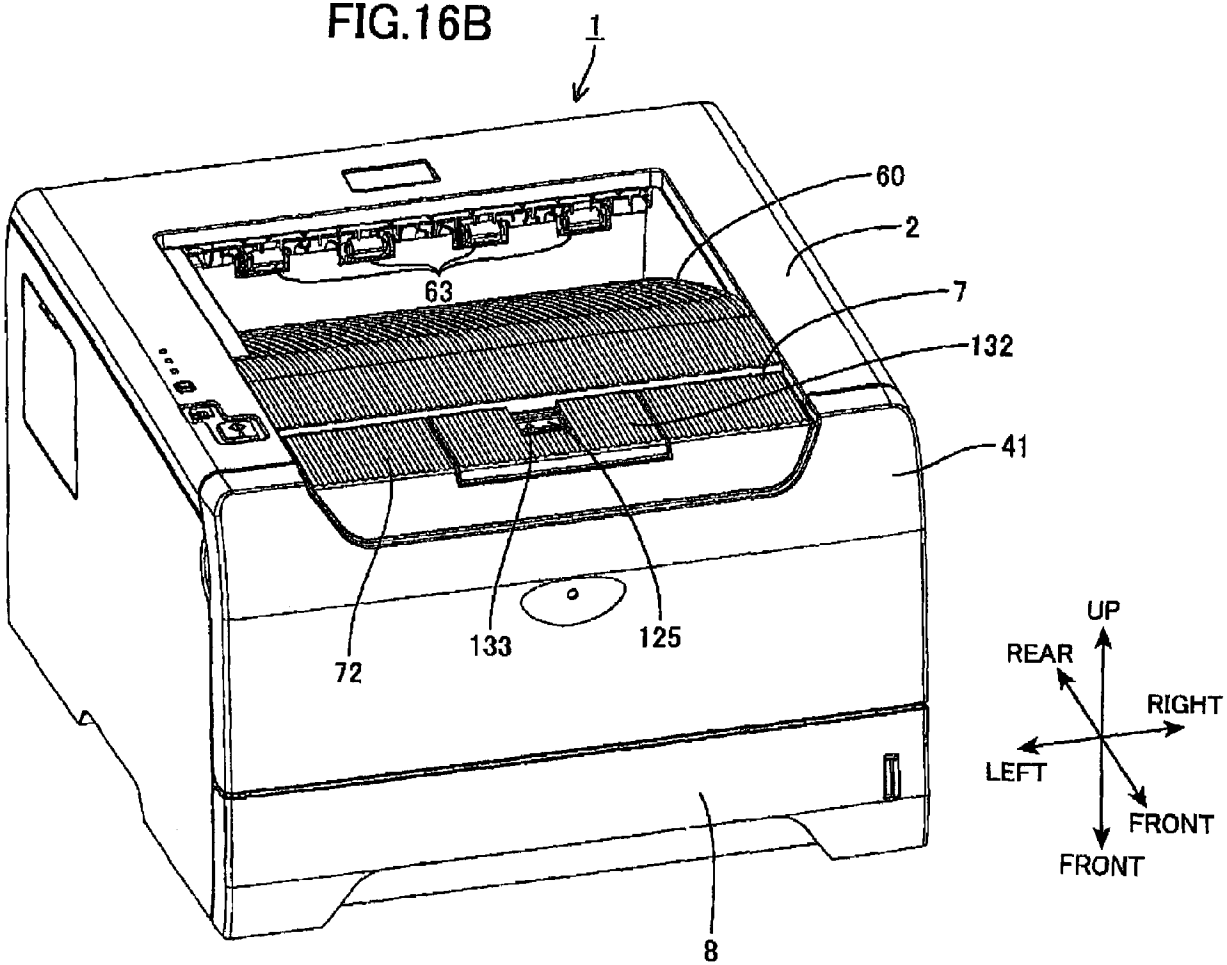
Figure 16C:
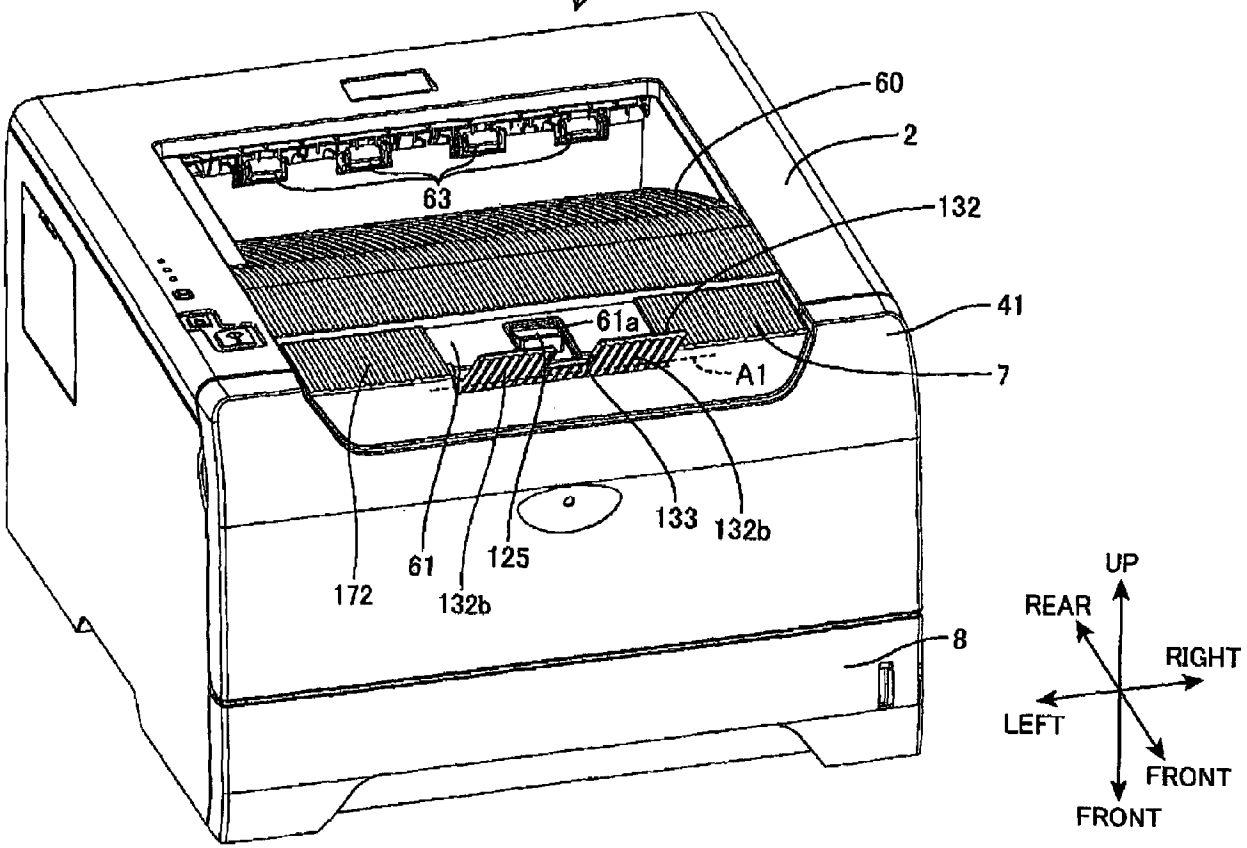

FIG., 2 is a perspective view of the laser printer in FIG. 1 when a front cover is closed;

FIG. 3 is a perspective view of the laser printer when the front cover is open;

FIG. 4 is a perspective view illustrating the method of removing a process cartridge from the laser printer;

FIG. 5 is a perspective view of the laser printer when a multipurpose tray is open;

FIG. 6 is a plan view of the laser printer when the front cover and an extension tray are closed;

FIG. 7 is a perspective view of the laser printer when the extension tray is open;

FIG. 8 is a cross-sectional view of a portion of the laser printer when a multipurpose tray is open;

FIG. 9A is a cross-sectional view of an essential part of the laser printer, in which an engaging mechanism for the front cover is in an engaged state;

FIG. 9B is a cross-sectional view of the essential part of the laser printer, in which the engaging mechanism for the front cover is in a disengaged state;

FIG. 9C is a cross-sectional view of of the essential part of the laser printer, in which the extension tray is open;

FIG. 10 is a perspective view of a main cover part;

FIG. 11 is a perspective view of a tray-operation insert forming a portion of the engaging mechanism;

FIG. 12 is a plan view of the tray-operation insert;

FIG. 13A is a side view illustrating a U-shaped arm of the tray-operation insert in the normal state;

FIG. 13B is a side view illustrating how the U-shaped arm is resiliently bent downwardly;

FIG. 14 is a side view illustrating a rotation-preventing portion;

FIG. 15 illustrates a shape of the extension tray;

FIG. 16A illustrates a shape of an extension tray in a variation;

FIG. 16B is a perspective view of a laser printer provided with the extension tray of FIG. 16A, in which the extension tray is closed; and FIG. 16C is a perspective view of the laser printer of FIG. 16B, in which the extension tray is open.

DETAILED DESCRIPTION

An embodiment of the invention will be described while referring to the accompanying drawings wherein like parts and components are designated by the same reference numerals to avoid duplicating description.

Overall Structure of Image-forming Device

FIG. 1 is a side cross-sectional view of a laser printer 1 according to an embodiment of the invention. As shown in FIG. 1, the laser printer 1 includes a main casing 2 and, within the main casing 2, a feeding unit 4 for supplying sheets of a paper 3, and an image-forming unit 5 for forming images on the paper 3 supplied by the feeding unit 4.

In the following description, the expressions "front", "rear", "upper", "lower", "right", and "left" are used to define the various parts when the laser printer 1 is disposed in an orientation in which it is intended to be used. In use, the laser printer 1 is disposed as shown in FIG. 1. A width direction D is defined in the right-to-left direction.

Main Casing

Figure 2:
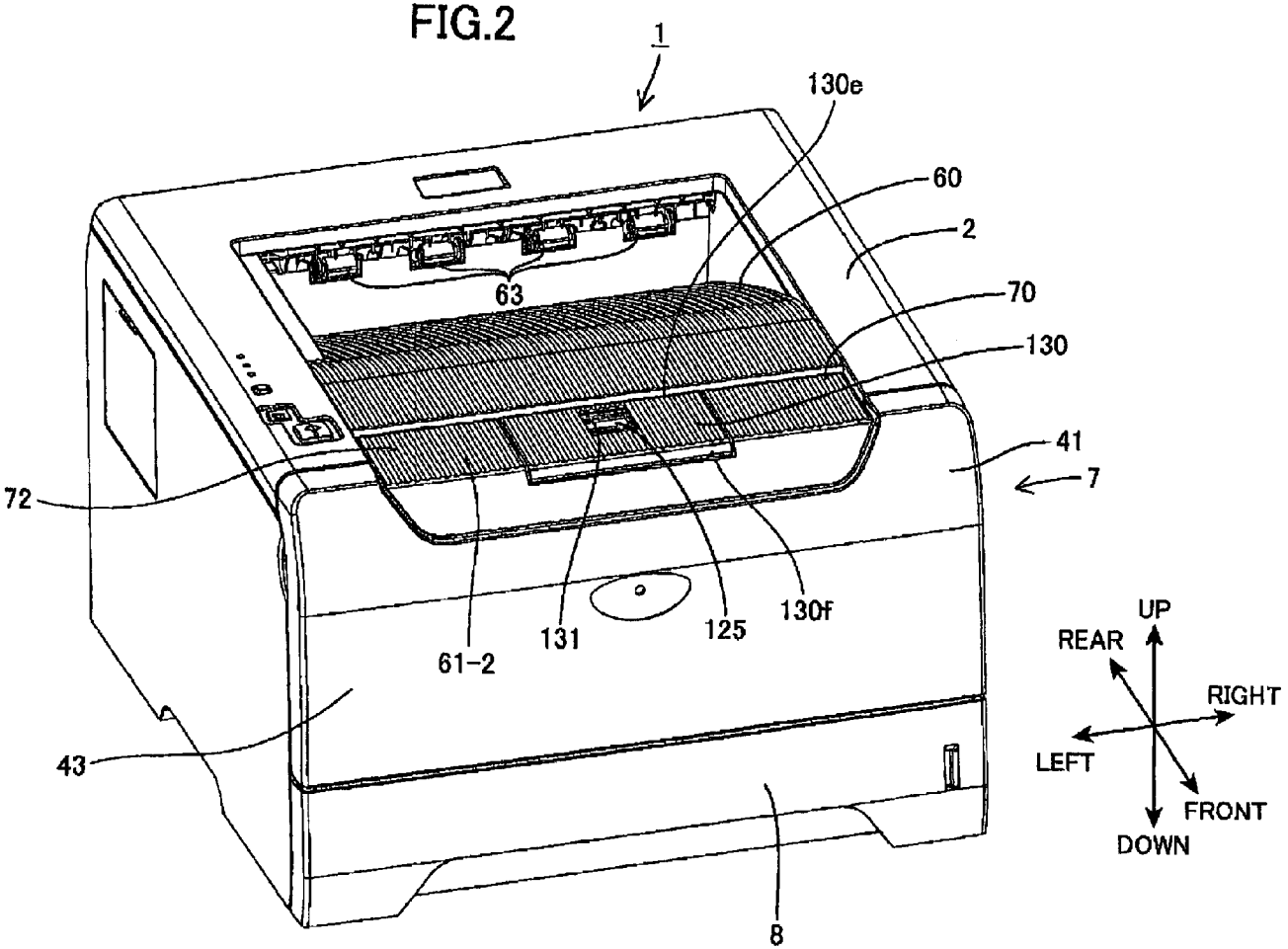

An access opening 6 is formed in the front side of the main casing 2 for inserting and removing a process cartridge 18 described later. As shown in FIG. 1 and FIG. 2, a front cover 7 is disposed on the front side of the laser printer 1. As shown in FIG. 3 and FIG. 4, the front cover 7 is rotatably supported on the main casing 2, and is capable of opening and closing over the access opening 6.

Feeding Unit

The feeding unit 4 includes a paper tray 8 that is detachably mounted in a lower section of the main casing 2, a separating roller 9 and a separating pad 10 disposed above the front end of the paper tray 8, and a feeding roller 11 disposed on the rear side of the separating roller 9 upstream of the separating pad 10 with respect to the conveying direction of the paper 3.

The feeding unit 4 also includes a paper dust roller 12 disposed above and forward of the separating roller 9 downstream of the separating roller 9 in the paper-conveying direction, and an opposing roller 13 disposed in opposition to the paper dust roller 12. A first conveying path 14 reverses the paper-conveying direction toward the rear end of the laser printer 1, forming a U-shape near the paper dust roller 12. A pair of registration rollers 15 is disposed below the process cartridge 18 farther downstream of the U-shaped portion of the paper-conveying path with respect to the paper-conveying direction.

A paper-pressing plate 16 is provided inside the paper tray 8 for supporting the paper 3 in a stacked state. The paper-pressing plate 16 is pivotably supported on the rear end thereof about a lever shaft (not shown), so that the front end can move in up-to-down direction.

A lever 17 is provided in the front section of the paper tray 8 for lifting the front end of the paper-pressing plate 16 upward. The rear end of the lever 17 is pivotably supported on a lever shaft (not shown) at a position below the front end of the paper-pressing plate 16 so that the front end of the lever 17 can contact the lower surface of the paper-pressing plate 16. When a counterclockwise rotational driving force is inputted into the lever shaft, the lever 17 rotates about the lever shaft and the front end of the lever 17 raises the front end of the paper-pressing plate 16, shifting the paper-pressing plate 16 into the supplying position.

When the front end of the paper-pressing plate 16 is raised (the supplying position), the topmost sheet of the paper 3 stacked on the paper-pressing plate 16 is pressed against the feeding roller 11. The rotating feeding roller 11 begins feeding this topmost sheet of paper 3 toward a separating position between the separating roller 9 and separating pad 10.

When the paper tray 8 is removed from the main casing 2, the rotating drive force is no longer inputted into the lever shaft, and the front end of the paper-pressing plate 16 drops downward by its own weight until the paper-pressing plate 16 rests on the bottom surface of the paper tray 8. At this time, the paper 3 can be stacked on top of the paper-pressing plate 16.

When the feeding roller 11 conveys a sheet of the paper 3 toward the separating position and the sheet becomes interposed between the separating roller 9 and the separating pad 10, the rotating separating roller 9 can certainly separate and supply the paper 3 one sheet at a time. The sheet of paper 3 supplied by the separating roller 9 travels along the U-shaped first conveying path 14. Hence, the conveying path 14 reverses the direction in which sheet of paper 3 is conveyed. Thus the sheet of paper 3 is conveyed toward the rear end of the laser printer 1. More specifically, the feeding roller 11 conveys a sheet of paper 3 between the separating roller 9 and separating pad 10 to the paper dust roller 12 and opposing roller 13. The paper dust roller 12 and opposing roller 13 convey the sheet of paper 3 upwardly to the front. The paper dust roller 12 and opposing roller 13 convey the paper 3 to the registration rollers 15 while removing paper dust from the paper 3 as the paper 3 passes therebetween.

After adjusting the paper 3 to a proper registration, the registration rollers 15 convey the paper 3 toward a transfer position in the image-forming unit 5 (a nip position between a photosensitive drum 28 and a transfer roller 30 described later at which position a toner image carried on the photosensitive drum 28 is transferred onto the paper 3).

Image-forming Unit

The image-forming unit 5 includes a scanning unit 19, the process cartridge 18, and a fixing unit 20.

The scanning unit 19 is disposed in the top section of the main casing 2 and includes a laser light source (not shown), a polygon mirror 21 that can be driven to rotate, an fθ lens 22, a reflecting mirror 23, a lens 24, and a reflecting mirror 25. The laser light source emits a laser beam based on image data. As illustrated by a dotted line in FIG. 1, the laser beam is deflected by the polygon mirror 21, passes through the fθ lens 22, is reflected rearward by the reflecting mirror 23, passes through the lens 24, and is reflected downward and rearward by the reflecting mirror 25 to be irradiated on the surface of the photosensitive drum 28 described later in the process cartridge 18.

The process cartridge 18 is detachably mounted in the main casing 2 beneath the scanning unit 19. The process cartridge 18 includes a drum cartridge 26 and a developer cartridge 27 that is detachably mounted on the drum cartridge 26.

The developer cartridge 27 is mounted on the front side of the drum cartridge 26. On the rear side, the drum cartridge 26 includes the photosensitive drum 28, a Scorotron charger 29, the transfer roller 30, and a cleaning brush 31.

The charger 29 is disposed in confrontation with the photosensitive drum 28 and is distant away from the photosensitive drum 28 by a prescribed distance and is capable of charging the surface of the photosensitive drum 28 with a uniform positive polarity.

The developer cartridge 27 includes a toner-accommodating chamber 32 for accommodating toner, a supply roller 33, a developing roller 34, and a thickness-regulating blade 35.

An agitator 36 is provided in the toner-accommodating chamber 32 for stirring the toner therein and discharging some of the toner toward the supply roller 33. Toner discharged toward the supply roller 33 by the rotating agitator 36 is supplied onto the developing roller 34 by the rotation of the supply roller 33. At this time, the toner is positively tribocharged between the supply roller 33 and developing roller 34. As the developing roller 34 rotates, the toner supplied onto the surface of the developing roller 34 passes between the thickness-regulating blade 35 and the developing roller 34 so that the toner carried on the developing roller 34 is smoothed to a thin layer of uniform thickness.

After the charger 29 has formed a uniform positive charge on the surface of the photosensitive drum 28 with the photosensitive drum 28 rotating, the scanning unit 19 irradiates a laser beam onto the surface of the photosensitive drum 28 in a high-speed scan in order to form an electrostatic latent image on the photosensitive drum 28 corresponding to an image to be formed on the paper 3.

Next, the positively charged toner carried on the surface of the developing roller 34 is brought into contact with the photosensitive drum 28 as the developing roller 34 rotates. At this time, the latent image formed on the surface of the photosensitive drum 28 is developed into a visible image when the toner is selectively attracted to portions of the photosensitive drum 28 that are exposed to the laser beam and, therefore, that have a lower potential than the rest of the surface having a uniform positive charge. In this way, a toner image is formed through a reverse developing process.

Subsequently, as the registration rollers 15 convey a sheet of the paper 3 through the transfer position between the photosensitive drum 28 and transfer roller 30, the toner image carried on the surface of the photosensitive drum 28 is transferred onto the paper 3 by a transfer bias applied to the transfer roller 30. After the toner image has been transferred onto the paper 3, the paper 3 is conveyed to the fixing unit 20. Toner remaining on the surface of the photosensitive drum 28 after the transfer operation is recovered on the developing roller 34. Further, paper dust deposited on the photosensitive drum 28 from the paper 3 is removed from the photosensitive drum 28 by the cleaning brush 31 after the transfer operation.

The fixing unit 20 is disposed rearward of the process cartridge 18 and downstream of the same in the paper-conveying direction. The fixing unit 20 includes a heating roller 37, a pressure roller 38, and conveying rollers 39.

The heating roller 37 includes a metal tube, and a halogen lamp disposed inside the tube for heating the same. The heating roller 37 is driven to rotate by a driving force inputted from a motor (not shown). The pressure roller 38 is disposed below and in opposition to the heating roller 37 and contacts the heating roller 37 with pressure. The pressure roller 38 follows the rotational drive of the heating roller 37.

The conveying rollers 39 are disposed downstream of the heating roller 37 and pressure roller 38 in the paper-conveying direction.

Toner that has been transferred onto the paper 3 is melted by heat and fixed to the paper 3 as the paper 3 passes between the heating roller 37 and pressure roller 38. Next, the conveying rollers 39 convey the paper 3 toward a pair of discharge rollers 63. As the conveying rollers 39 convey the paper 3, a guide section 40 extending vertically in the rear section of the main casing 2 guides the paper 3 along a U-shaped path, reversing the direction in which the paper 3 is conveyed. The discharge rollers 63 then discharge the paper 3 onto a discharge tray 60 formed on top of the main casing 2. The discharge tray 60 supports paper that is discharged after being subjected to the image-forming process.

Front Cover

The front cover 7 is provided on the front side of the main casing 2 that is downstream from the discharge tray 60 in the paper discharge direction, and that is capable of opening and closing on the front side of the main casing 2.

As shown in FIG. 1-FIG. 5, the front cover 7 includes a main cover part 70 and a multipurpose tray (MP tray) 41. As shown in FIG. 3, the main cover part 70 is rotatably supported on the main casing 2 about a shaft 162 that is inserted through a bottom end of the main cover part 70. The shaft 162 extends in the width direction D. The main cover part 70 is freely pivotable about the shaft 162 so that the free end (upper end) of the main cover part 70 can open and close the opening 6.

As shown in FIG. 5 and FIG. 10, the main cover part 70 has: a front wall 73; left and right side extensions 71; and an upper extension 72. The front wall 73 extends substantially vertically. The left and right side extensions 71 are provided on the left and right sides of the front wall 73. The upper extension 72 is provided on the upper side of the front wall 73. A left-side outer edge of the upper extension 72 is in continuation with a right-side inner edge of the left side extension 71, and a right-side outer edge of the upper extension 72 is in continuation with a left-side inner edge of the right side extension 71. A rectangular opening 7*a* is formed in the front wall 73 to penetrate the thickness thereof.

The MP tray 41 is pivotably supported on the main cover part 70 so that the MP tray 41 can be opened and closed relative to the main cover part 70.

When the MP tray 41 is closed on the main cover part 70 as shown in FIG. 2 and FIG. 6, the MP tray 41 covers the entire part of the main cover part 70 except for the upper extension 72. Accordingly, the MP tray 41 covers the opening 7*a*. When the MP tray 41 is opened on the main cover part 70 as shown in FIG. 5, the entire part of the main cover part 70 including the opening 7*a* is exposed outside.

When the MP tray 41 and the main cover part 70 are both closed as shown in FIG. 2 and FIG. 6, the MP tray 41 covers the front side of the main casing 2, and the upper extension 72 of the main cover part 70 is disposed in continuation with the discharge tray 60. As shown in FIG. 6, the MP tray 41 and the main cover part 70 span the entire region C1 of the laser printer 1 in the width direction D. When the main cover part 70 and the MP tray 41 are rotated together to be opened as shown in FIG. 3 and FIG. 4, the access opening 6 is exposed, enabling the process cartridge 18 to be mounted into or removed from the main casing 2 via the access opening 6.

As shown in FIG. 2, FIG. 6, and FIG. 7, an extension tray 130 is provided on the upper extension 72 of the main cover part 70. The extension tray 130 is of a rectangular plate shape. The extension tray 130 is pivotable about a rotational axis A1 (indicated conceptually by a dotted line in the drawings), and is capable of opening and closing over the upper extension 72. The rotational axis A1 extends in the width direction D. When the extension tray 130 is closed as shown in FIG. 2 and FIG. 6, the extension tray 130 covers the top surface of the upper extension 72 at its widthwise center region. Accordingly, the extension tray 130 occupies a widthwise center region C2 of the laser printer 1 as shown in FIG. 6. The extension tray 130 can be opened to the state shown in FIG. 7.

Multipurpose Function

As shown in FIG. 1, in addition to the feeding mechanism for conveying the paper 3 from the paper tray 8 to the transfer position via the first conveying path 14, the laser printer 1 also has a multipurpose mechanism (manual feeding mechanism) for conveying a manually fed sheet from the MP tray 41 to the transfer position.

More specifically, the feeding unit 4 further includes a multipurpose feeding mechanism 42 (hereinafter referred to as "MP feeding mechanism 42") for feeding the paper 3 loaded on the MP tray 41.

As shown in FIG. 5 and FIG. 8, the MP tray 41 includes a MP-tray cover part 43, a tray part 44 (FIG. 1) for supporting manually fed paper 3, and a guide mechanism 49. As shown in FIG. 5, the MP-tray cover part 43 is pivotably supported on the main cover part 70 about a rotational shaft 43*a* formed in the lower end of the MP-tray cover part 43. The rotational shaft 43*a* extends in the width direction D. A rotational axis of the rotational shaft 43*a* may be in line with a rotational axis of the shaft 162. The MP-tray cover part 43 can rotate open and closed on the main cover part 70 about the rotational shaft 43*a*. When the MP-tray cover part 43 is rotated open as shown in FIG. 5 and FIG. 8, the MP-tray cover part 43 is fixed in a position in which an inner surface 43*b* of the MP-tray cover part 43 faces upward. The tray part 44 and the guide mechanism 49 are provided on the inner surface 43*b*.

The tray part 44 is configured of a first tray plate 45 disposed on the inner surface 43*b* of the MP-tray cover part 43, and a second tray plate 46 rotatably supported on a front end of the first tray plate 45. Of these, the first tray plate 45 can be slid to a position accommodated inside of the inner surface 43*b* of the MP-tray cover part 43 when the MP tray 41 is in the closed state as shown in FIG. 1. That is, seeing from front side, the area of the first tray plate 45 is within the area of the inner surface 43*b*. When the MP tray 41 is in the open state as shown in FIG. 8, the first tray plate 45 can slide within a guiding groove 47 to a position in which the front portion of the first tray plate 45 protrudes farther forward from the MP-tray cover part 43.

The second tray plate 46 is rotatably supported on the front end of the first tray plate 45 and can rotate between a position folded over the top surface of the first tray plate 45 (see FIG. 1) and a position extending from the front of the first tray plate 45 (see FIG. 8). As shown in FIG. 8, the tray part 44 slopes downward toward the rotational shaft 43*a* side end (the end in which the paper 3 is inserted) when the MP tray 41 is in the open state.

The guide mechanism 49 guides paper 3 supported on the tray part 44 when the tray part 44 is open. The guide mechanism 49 has a pair of guiding ribs 48 (only one of the guiding ribs 48 is shown in FIG. 1 and FIG. 8) for guiding both widthwise sides of the paper 3 as the paper 3 is conveyed. The guiding ribs 48 can be slid between a position close to each other and a position separated farther from each other, enabling the MP tray 41 to support a stack of paper 3 of a desired size.

When the MP tray 41 is in the closed position shown in FIG. 1, the guide mechanism 49 is positioned rearward of the upper end of the folded tray part 44 (a space above the MP feeding mechanism 42). When the MP tray 41 is opened to the state shown in FIG. 8, the guide mechanism 49 slides in a guiding groove 50 to a position rearward of the first tray plate 45.

As shown in FIG. 8, a second conveying path 54 extends from the opening 7*a* to join the first conveying path 14. The MP feeding mechanism 42 is disposed on the conveying path 54 The MP feeding mechanism 42 includes a multipurpose feeding roller 51 (hereinafter referred to as an "MP feeding roller 51"), a multipurpose separating roller 52 (hereinafter referred to as an "MP separating roller 52"), and a multipurpose separating pad 53 (hereinafter referred to as an "MP separating pad 53") disposed in confrontation with the MP separating roller 52. With the MP separating roller 52 and MP separating pad 53 confronting and contacting each other, an urging member (not shown) provides an urging force for pressing the MP separating pad 53 against the MP separating roller 52. In other words, the multipurpose mechanism of the embodiment is a twin roller system configured of the MP feeding roller 51 and MP separating roller 52, with the MP feeding roller 51 disposed near the MP tray 41 and the MP separating roller 52 disposed rearward of the MP feeding roller 51.

The MP feeding roller 51 rotates to feed the topmost sheet of the paper 3 stacked on the MP tray 41 between the MP separating roller 52 and MP separating pad 53. At this time, the MP separating roller 52, through cooperation with the MP separating pad 53, separates and feeds the paper 3 on to the second conveying path 54 one sheet at a time. The second conveying path 54 guides the paper 3 toward the registration rollers 15 so that the paper 3 enters the first conveying path 14 at a point just upstream of the registration rollers 15.

Upper Extension

As shown in FIG. 9A, the upper extension 72 has substantially a U-shaped cross-section, and has a front base 62, a top wall 61, and a bottom wall 64. The bottom wall 64 and the top wall 61 extend rearwardly from the lower and upper edges of the front base 62, respectively. The rear edge of the bottom wall 64 is in continuation with the upper edge of the front wall 73. The rear edge of the top wall 61 is in confrontation with the front edge of the discharge tray 60 in the main casing 2 when the main cover part 70 is closed on the main casing 2.

A tray-operation insert 150 is inserted in the U-shaped upper extension 72 so that the tray-operation insert 150 is located between the top wall 61 and the bottom wall 64 and rear to the front base 62.

The extension tray 130 is rotatably supported on the top wall 61.

As shown in FIG. 6 and FIG. 7, the top wall 61 is divided into three sections of: a central section 61-1 that occupies the central region C2 of the laser printer 1 and that can be covered by the extension tray 130; and left and right side sections 61-2 that are on the left and right sides of the central section 61-1. FIG. 10 shows the top wall 61, from which the extension tray 130 is omitted.

As shown in FIG. 10, the central section 61-1 is substantially of a rectangular-shape. In the central section 61-1, the top wall 61 has a first recess 61F and a second recess 61S on its upper surface. The first recess 61F is positioned on the front side of the second recess 61S. In other words, the first recess 61F is positioned in the downstream side of the second recess 61S in the paper discharging direction.

The area of the substantially rectangular-shaped central section 61-1 is substantially equal to or slightly greater than the area of the rectangular-shaped extension tray 130. The depth of the second recess 61S is substantially equal to or slightly greater than the thickness of the extension tray 130. The depth of the first recess 61F is greater than that of the second recess 61S. Accordingly, when the extension tray 130 is closed on the central section 61-1 of the top wall 61 as shown in FIG. 2, the extension tray 130 is properly fitted in the central section 61-1 of the top wall 61.

The top wall 61 has a third recess 61T in the widthwise center of the second recess 61S. The top wall 61 has a rectangular through-hole 161 in the third recess 61T. The through-hole 161 penetrates the top wall 61 through the thickness thereof.

In the third recess 61T, the top wall 61 has a downstream side edge 61*c* of the through-hole 161 in the paper discharging direction. In the second recess 61S except for the region of the third recess 61T, the top wall 61 has an upstream side edge 61*a* of the through-hole 161 in the paper discharging direction and a downstream side point 61*b* that is located next to the downstream side edge 61*c* in the widthwise direction D and therefore that is located also on the downstream side of the through-hole 161 in the paper discharging direction.

The top wall 61 has left and right side walls 65 that extend vertically from the bottom surface of the first recess 61F to the top surface of the top wall 61 at the left and right side sections 61-2. Holes 67 are formed on the left and right side walls 65, respectively, to define the rotational axis A1 therebetween. The holes 67 rotatably support a rotational shaft (not shown) of the extension tray 130.

The top wall 61 has left and right side through-holes 69 in the first recess 61F at its left and right side edges near to the left and right side walls 65. The left and right side through-holes 69 penetrate the top wall 61 through the thickness thereof.

As shown in FIG. 11, the tray-operation insert 150 is integrally formed of resin. As shown in FIG. 11, the tray-operation insert 150 includes a base part 151 and an extended part 152. The extended part 152 includes a U-shaped arm 123 that supports a pair of engaging pawls 121 and an engagement/disengagement operation protrusion 125 thereon.

The U-shaped arm 123 protrudes from the base part 151 so that the U-shaped arm 123 is disposed in the widthwise center of the base part 151. As shown in FIG. 12, a gap 127 is formed as being surrounded by the U-shaped arm 123 and the base part 151. The engaging pawls 121 and the engagement/disengagement operation protrusion 125 are provided on the U-shaped arm 123 so that the engaging pawls 121 and the engagement/disengagement operation protrusion 125 are disposed in the widthwise center of the U-shaped arm 123 and so that the engaging pawls 121 are located further away from the base part 151 than the engagement/disengagement operation protrusion 125. With this configuration, when the engagement/disengagement operation protrusion 125 is depressed downwardly from the normal state shown in FIG. 13A, the arm 123 is resiliently deformed to allow the engaging pawls 121 to move downwardly. The top surface of the engagement/disengagement operation protrusion 125 has an upstream end 125*a* and a downstream end 125*b* and is formed gradually higher from the upstream end 125*a* toward the downstream end 125*b*.

As shown in FIG. 11, the base part 151 supports left and right side rotation-preventing portions 141 at its left and right side edges, respectively. As shown in FIG. 14, each rotation-preventing portion 141 includes a thin plate portion 141*b* and a protrusion 141*a* provided on the thin plate portion 141*b*. The thin plate portion 141*b* is connected at its rear edge to the base part 151, while forming a gap 142 between its front edge and the base part 151. Accordingly, when the protrusion 141*a* is depressed downwardly, the thin plate portion 141*b* is resiliently deformed downwardly to allow the protrusion 141*a* to move downwardly. The rotation-preventing portion 141 serves to prevent the extension tray 130 from rotating relative to the front cover 7 as will be described later, Although not shown in FIG. 11, the base part 151 is formed with a plurality of through-holes 155 that are arranged in the width direction. Only one of the through-holes 155 is shown in FIG. 9A. The upper extension 72 of the main cover part 70 has a plurality of bosses 74 that are arranged in the width direction and that protrude from the front base 62 rearwardly. Only one of the bosses 74 is shown in FIG. 9A. The tray-operation insert 150 is held in the U-shaped upper extension 72 by engaging the bosses 74 into the through-holes 155.

When the tray-operation insert 150 is thus held in the U-shapes upper extension 72, the arm 123 is disposed in the upstream side relative to the base part 151 in the discharge direction. The base part 151 is fixedly secured to the front base 62, while the arm 123 is elastically deformable relative to the base part 151. The engaging pawls 121 and the engagement/disengagement operation protrusion 125 are disposed in the widthwise center of the upper extension 72. As shown in FIG. 10, the engagement/disengagement operation protrusion 125 protrudes via the through-hole 161 upwardly from below the top wall 61. Each protrusion 141*a* protrudes via the corresponding through-hole 69 upwardly from below the top wall 61.

On the U-shaped arm 123, the engaging pawls 121 are disposed upstream of the engagement/disengagement operation protrusion 125 in the discharge direction. On the engagement/disengagement operation protrusion 125, the upstream end 125*a* is disposed on the upstream side of the downstream end 125*b*. In other words, the top surface of engagement/disengagement operation protrusion 125 is formed gradually higher from the upstream end 125*a* toward the downstream end 125*b*.

The U-shaped arm 123 is elastically deformable relative to the base part 151 that is now fixedly secured to the main cover part 70. When the user presses the engagement/disengagement operation protrusion 125 downwardly, the U-shaped arm 123 deforms elastically downwardly, thereby allowing the engaging pawls 121 to move downwardly.

The main casing 2 includes a pair of engagement pawls 122. Only one of the engagement pawls 122 is shown in FIG. 9A. The pair of engagement pawls 122 protrude downward from the front edge of the discharge tray 60. With this configuration, when the main cover part 70 is closed as shown in FIG. 9A, the engaging pawls 121 on the tray-operation insert 150 engage with the engagement pawls 122 on the main casing 2 side. When the user presses down on the engagement/disengagement operation protrusion 125, as shown in FIG. 9B, the arm 123 is elastically deformed downwardly, allowing the engaging pawls 121 to be disengaged from the engagement pawls 122. As a result, the main cover part 70 can be rotated forward in the direction F in FIG. 9B. Thus, an engaging mechanism is provided by the engaging pawls 121, the engagement pawls 122, and the engagement/disengagement operation protrusion 125.

As shown in FIG. 9A and FIG. 9B, the extension tray 130 is mounted on the top surface of the top wall 61. The extension tray 130 is rotatably supported by its shaft (not shown) inserted in the holes 67 (FIG. 10) that are formed in the left and right side walls 65 of the top wall 61. That is, the extension tray 130 is rotatably supported about the rotational axis A1. As shown in FIG. 9A, the rotational axis A1 is located downstream of the engagement/disengagement operation protrusion 125 in the discharging direction.

As shown in FIG. 15, the extension tray 130 includes a base-end-side portion 130*c*, left and right-side portions 130*b*, and a tip-end-side portion 130*a*. The extension tray 130 has the shaft (not shown) on the base-end-side portion 130*c*, and is rotatably supported via the shaft (not shown) about the rotational axis A1 on the top wall 61. The extension tray 130 has a tip end 130*e* on the tip-end-side portion 130*a*. On the base-end-side portion 130*c*, the extension tray 130 has a base end 130*f* that is opposite to the tip end 130*e*. The extension tray 130 has a rectangular opening or through-hole 131 that is surrounded by all of the tip-end-side portion 130*a*, the left and right side portions 130*b*, and the base-end-side portion 130*c*. The opening 131 penetrates the extension tray 130 through the thickness thereof. The tip-end-side portion 130*a* has a tip-end-side edge 131*a* of the opening 131.

The extension tray 130 can rotate about the rotational axis A1 between a closed position shown in FIG. 2 and FIG. 9A, in which the tip end 130*e* is positioned upstream of the rotational axis A1 in the discharge direction, and a open position shown in FIG. 7 and FIG. 9C, in which the tip end 130*e* is positioned downstream of the rotational axis A1 in the discharge direction.

When the extension tray 130 is in the closed position shown in FIG. 9A, the extension tray 130 covers the center section 61-1 of the top wall 61, with its opening 131 confronting the thorough-hole 161. Accordingly, the top surface of the engagement/disengagement operation protrusion 125 is exposed thorough the opening 131. The tip end 130*e* of the extension tray 130 is positioned upstream of the thus exposed engagement/disengagement operation protrusion 125 in the discharge direction. The exposed engagement/disengagement operation protrusion 125 is disposed within the widthwise central region C2 of the laser printer 1 that is occupied by the extension tray 130 as shown in FIG. 6.

On the other hand, when the extension tray 130 is in the open position shown in FIG. 7 and FIG. 9C, the extension tray 130 is extended downstream from the front cover 7 in the discharge direction, and is therefore capable of supporting a leading edge of the paper discharged onto the discharge tray 60.

As shown in FIG. 9C, the extension tray 130 has a tapered surface 133 on the tip-end-side portion 130*a* at the tip-end-side edge 131*a* of the opening 131. When the extension tray 130 is in the open position of FIG. 9C, the tapered surface 133 faces in a direction toward the upstream side in the discharging direction. When the extension tray 130 is in the open position of FIG. 9C, the tapered surface 133 is located on the downstream side of the opening 131. The tapered surface 133 is tapered in a direction from the tip end 130*e* toward the tip-end-side edge 131*a* of the opening 131. In other words, the tapered surface 133 is tapered toward the upstream side in the discharge direction when the extension tray 130 is in the open position of FIG. 9C.

When the extension tray 130 is in the closed position shown in FIG. 9A, the tapered surface 133 faces downwardly and is positioned above the upstream end 125*a* of the engagement/disengagement operation protrusion 125, to form a space between the tapered surface 133 and the upstream end 125*a*, enabling the user to access the tapered surface 133 and operate the extension tray 130 at the tapered surface 133.

When the extension tray 130 is in the open position shown in FIG. 9C, the upstream end 125*a* is positioned at a level lower than the upstream side edge 61*a* of the top wall 61 that is located upstream of and next to the upstream end 125*a* of the engagement/disengagement operation protrusion 125. The downstream end 125*b* of the engagement/disengagement operation protrusion 125 is positioned at a level higher than both of the downstream side edge 61*c* and the downstream side point 61*b* of the top wall 61 that are located downstream of and adjacent to the downstream end 125*b* of the engagement/disengagement operation protrusion 125.

As shown in FIG. 9A, the rotation-preventing portion 141 is located below the extension tray 130. When the user attempts to rotate the extension tray 130 from the closed state of FIG. 9A, the base end 130*f* of the extension tray 130 is brought into abutment contact with the protrusion 141*a* because the protrusion 141*a* is located in the rotating path of the base end 130*f*. Hence, the rotation-preventing portion 141 restricts rotation of the extension tray 130, particularly rotation with low force. More specifically, if the user attempts to rotate the extension tray 130 with a sufficiently large force that deforms the entire rotation-preventing portion 141 downwardly to push the protrusion 141*a* out of the rotating path of the extension tray 130, the protrusion 141*a* becomes disengaged from the base end 130*f* and allows the base end 130*f* to move from the state shown in FIG. 9A to a position beyond the protrusion 141*a* shown in FIG. 9C. The same process is performed in reverse when moving the base end 130*f* from the position shown in FIG. 9C to the position shown in FIG. 9A by applying a sufficiently large force. With this construction, the front cover 7 can be opened and closed with the extension tray 130 folded closed, without the extension tray 130 swinging needlessly.

Since the extension tray 130 is supported on the front cover 7, the extension tray 130 is positioned farther downstream in the discharge direction and can support paper of a large size without being formed of a larger size itself.

The engagement/disengagement operation protrusion 125 is operable even when the extension tray 130 is folded in the closed position shown in FIG. 2 and FIG. 9A. By providing the extension tray 130 on the front cover 7 in this way, the engagement/disengagement operation protrusion 125 used to open and close the front cover 7 is prevented from interfering with the extension tray 130. Hence, opening and closing operations of the front cover 7 are not hindered by the extension tray 130.

By providing the extension tray 130 in the widthwise center section 61-1 on the front cover 7, the extension tray 130 can support paper with great stability. Further, the engagement/disengagement operation protrusion 125 is easy to operate when positioned in this region. The engagement/disengagement operation protrusion 125 can be operated when the extension tray 130 is folded over in the closed position shown in FIG. 9A, thereby achieving both stable support of the paper and operability without the extension tray 130 and the engagement/disengagement operation protrusion 125 interfering with each other.

As illustrated in FIG. 9A and FIG. 9B, the engagement/disengagement operation protrusion 125 can be operated by pushing the engagement/disengagement operation protrusion 125 downward. The top surface of the engagement/disengagement operation protrusion 125 is exposed even when the extension tray 130 is in the closed position. Therefore, the front cover 7 can be opened and closed through a simple operation, and the conditions for operating the engagement/disengagement operation protrusion 125 are effectively preserved even when the extension tray 130 is folded closed.

As shown in FIG. 9A, the top surface of the engagement/disengagement operation protrusion 125 is formed gradually higher from the upstream end 125*a* toward the downstream end 125*b*. When the extension tray 130 is in the open position shown in FIG. 9C, the upstream end 125*a* is lower than the upstream side edge 61*a* of the top wall 61. The downstream end 125*b* of the engagement/disengagement operation protrusion 125 is formed higher than the downstream side edge 61*c* and the downstream side point 61*b* of the top wall 61. With this construction, when the extension tray 130 is in the open position, paper discharged onto the discharge tray 60 is unlikely to catch on the upstream side edge 125*a* of the engagement/disengagement operation protrusion 125 or to catch on the downstream side portions 61*b* and 61*c* of the top wall 61 when moving downstream over the engagement/disengagement operation protrusion 125, thereby ensuring a smooth discharge operation.

The tapered surface 133 is tapered toward the upstream side in the discharge direction when the extension tray 130 is in the open position of FIG. 9C. Therefore, paper is less likely to catch on the tip-end-side edge 131*a* (downstream side edge) of the opening 131 when the extension tray 130 is in the open position, ensuring a smooth discharge operation.

When the extension tray 130 is in the closed position shown in FIG. 9A, a gap is formed between the tapered surface 133 of the extension tray 130 and the upstream end 125*a* of the engagement/disengagement operation protrusion 125. Hence, in order to rotate the extension tray 130 from the closed position to the open position, the user can easily insert his/her finger into the gap between the upstream end 125*a* and the tapered surface 133 to grip and rotate the extension tray 130.

When the rotation-preventing portion 141 is in its natural state shown in FIG. 9A, the base end 130*f* of the extension tray 130 is brought into abutment contact with the protrusion 141*a* if the user attempts to rotate the extension tray 130. In other words, the rotation-preventing portion 141 is positioned in the path of the base end 130*f*. Hence, the rotation-preventing portion 141 restricts rotation of the extension tray 130, particularly rotation with low force. However, if the extension tray 130 is rotated with sufficiently large force to push the protrusion 141*a* out of its path, the entire rotation-preventing portion 141 flexes so that the protrusion 141*a* moves downward, disengaging the protrusion 141*a* from the base end 130*f* and allowing the base end 130*f* to move from the state shown in FIG. 9A to a position beyond the protrusion 141*a* shown in FIG. 9C. The same process is performed in reverse when moving the base end 130*f* from the position shown in FIG. 9C to the position shown in FIG. 9A by applying a sufficiently large force.

The engaging pawls 121 are disposed on the extended part 152 upstream of the engagement/disengagement operation protrusion 125 in the discharge direction. Therefore, the engaging pawls 121 can be displaced without applying a large force to the engagement/disengagement operation protrusion 125, facilitating the engaging and disengaging operations. Further, by providing the rotation-preventing portions 141 on the base end 130*f* side (rotational axis A1 side) of the extension tray 130, as shown in FIG. 9A, a force applied to the extension tray 130 is more effectively applied to the rotation-preventing portions 141 than if the rotation-preventing portions 141 were disposed on the tip end 130*e* side of the extension tray 130.

As described above, the engaging pawls 121 are disposed in the widthwise center of the front cover 7. By providing the entire engaging mechanism (engaging pawls 121, engagement pawls 122, and engagement/disengagement operation protrusion 125) in the widthwise center region, there is less chance of an unequal force being applied to either the left or right widthwise sides of the front cover 7, thereby facilitating the opening and closing operations of the same.

While the invention has been described in detail with reference to the specific embodiment thereof, it would be apparent to those skilled in the art that many modifications and variations may be made therein without departing from the spirit of the invention, the scope of which is defined by the attached claims.

(1) For example, in the embodiment described above, the opening 131 is surrounded by all of the tip-end-side portion 130*a*, the left and right-side portions 130*b*, and the base-end-side portion 130*c*, of the extension tray 130 (see FIG. 15). However, the tip-end-side portion 130*a* may be omitted. That is, the extension tray 130 may be modified into an extension tray 132 shown in FIG. 16A. The extension tray 132 has a cutout part 133. In other words, the extension tray 132 has only left and right side portions 132*b* and a base-end-side portion 132*c*. The cutout part 133 is in the form of a rectangular-shaped notch that is formed on the tip end of the extension tray 132. Also in this case, the extension tray 133 can be rotated between the closed position shown in FIG. 16B and an opened position shown in FIG. 16C. When the extension tray 133 is in the closed position shown in FIG. 16B, the cutout part 133 confronts the through-hole 161, thereby allowing the engagement/disengagement operation protrusion 125 to be exposed.

(2) In the embodiment described above, the engagement/disengagement operation protrusion 125 is exposed via the opening 131 when the extension tray 130 is in the closed position of FIG. 9A. However, the engagement/disengagement operation protrusion 125 may be exposed by shortening the extension tray 130 so that the tip end 130*e* will be positioned in the downstream side of the entire part of the engagement/disengagement operation protrusion 125 in the discharging direction when the extension tray 130 is in the closed position. In other words, the entire part of the extension tray 130 may be positioned in the downstream side of the entire engagement/disengagement operation protrusion 125 when the extension tray 130 is folded closed.

What is claimed is:

1. An image-forming device comprising:

a main casing having a discharge tray formed on a top surface thereof, the discharge tray supporting a recording medium discharged after an image-forming operation;

a cover member that covers a side surface of the main casing on a downstream side of the discharge tray with respect to a discharge direction in which the recording medium is discharged, and that is capable of opening and closing thereon;

an extension tray that is rotatably attached to an upper part of the cover member, that is capable of extending downstream from the discharge tray in the discharge direction, and that supports a portion of the discharged recording medium; and an engaging unit engaging the cover member with the main casing when the cover member is closed, the engaging unit comprising:

an engagement part provided on the main casing side; and an engaging part provided on the cover member side and being capable of engaging with the engagement part; and an operating part disposed on the cover member side that disengages the engaging part from the engagement part when operated, the extension tray having a rotational shaft provided downstream of the operating part in the discharge direction and being rotatably supported on the cover member about the rotational shaft to be capable of rotating between a first position in which a distal end of the extension tray is positioned upstream of the rotational shaft in the discharge direction and a second position in which the distal end is positioned downstream of the rotational shaft in the discharge direction, the operating part being capable of being operated when the extension tray is in the first position.

2. The image-forming device as claimed in claim 1, wherein the extension tray is disposed in a region of the cover member constituting a widthwise center portion thereof; and the operating part is disposed within the region occupied by the extension tray.

3. The image-forming device as claimed in claim 1, wherein the operating part has a pressing part that is operated by pressing downward; and the pressing part has a top surface that is exposed when the extension tray is in the first position.

4. The image-forming device as claimed in claim 1, wherein the distal end of the extension tray is positioned upstream of the operating part in the discharge direction when the extension tray is in the first position;

the extension tray has a cutout part formed in a portion thereof; and the operating part is exposed via the cutout part when the extension tray is in the first position.

5. The image-forming device as claimed in claim 1, wherein the distal end of the extension tray is positioned upstream of the operating part in the discharge direction when the extension tray is in the first position;

the extension tray has a through-hole that penetrates the extension tray through the thickness thereof; and the top surface of the operating part is exposed via the through-hole when the extension tray is in the first position.

6. The image-forming device as claimed in claim 4, wherein the top surface of the operating part has an upstream end and a downstream end with respect to the discharge direction and increases in height from the upstream end toward the downstream end;

the cover member has a first edge upstream from and adjacent to the upstream end of the operating part, and a second edge downstream from and adjacent to the downstream end of the operating part in the discharge direction; and wherein when the extension tray is in the first position, the upstream end of the operating part is lower than the first edge of the cover member, and the downstream end of the operating part is higher than the second edge of the cover member.

7. The image-forming device as claimed in claim 5, wherein the extension tray has a tapered portion that is located downstream from the opening in the discharge direction and that is formed with a tapered surface tapering forwarding upstream side in the discharge direction when the extension tray is in the second position.

8. The image-forming device as claimed in claim 7, wherein when the extension tray is in the first position, the tapered portion is positioned above the upstream end of the operating part and forms an operating space between the tapered portion and the operating part to allow accessing to the extension tray to operate the extension tray.

9. The image-forming device as claimed in claim 1, wherein the engaging part is disposed in the widthwise center of the cover member.

10. The image-forming device as claimed in claim 1, further comprising a second pressing part that is elastically deformable and that is capable of pressing against the extension tray from below, the second pressing part having a swing-preventing part preventing the extension tray from rotating, wherein the operating part, the engaging part, and the second pressing part are integrated together into an integrated component.

11. The image-forming device as claimed in claim 10, wherein the integrated component has a base part fixed to the cover member, and an extended part extending from the base part upstream in the discharge direction and capable of elastically deforming;

the swing-preventing part is provided on the base part;

the operating part is provided on the extended part; and the engaging part is provided on the extended part upstream of the operating part in the discharge direction.

* * * * *